US005215130A

United States Patent [19]

Kojima et al.

[11] Patent Number: 5,215,130

[45] Date of Patent: Jun. 1, 1993

[54] LIQUID-MIXTURE AUTO-APPLYING APPARATUS

[76] Inventors: Hisao Kojima, 53-21, Shioiri-cho 3-chome, Tsurumi-ku, Yokohama-shi, Kanaga-ken; Ryoji Saeki, 5-4-406, Izumi-cho 3-chome, Kokubunji-shi, Tokyo, both of Japan

[21] Appl. No.: 921,390

[22] Filed: Jul. 30, 1992

Related U.S. Application Data

[63] Continuation of Ser. No. 545,616, Jun. 29, 1990, abandoned.

[30] Foreign Application Priority Data

Jun. 30, 1989 [JP] Japan ..... 1-170592

[51] Int. Cl.[5] ..... B05B 7/00

[52] U.S. Cl. ..... 141/105; 141/82; 141/94; 141/144; 427/96; 427/421; 427/425; 427/426; 118/324; 118/697

[58] Field of Search ..... 141/9, 34, 82, 89, 100, 141/102, 105, 107, 144, 145, 168, 169, 171, 268, 270, 283, 94; 414/150–153, 156–158, 173, 176, 196, 198; 198/394, 429, 435, 457, 606, 607, 952; 427/96, 372.2, 378, 421, 424–426; 118/324, 697; 432/121, 124, 125, 128, 132; 34/203, 209, 210

[56] References Cited

U.S. PATENT DOCUMENTS

| | | | |
|---|---|---|---|
| 1,463,998 | 8/1923 | Hippenmeyer et al. | 141/102 |
| 2,034,921 | 3/1936 | Philips et al. | 141/105 X |
| 2,328,106 | 8/1943 | Strong | 118/324 |
| 2,899,789 | 8/1959 | Smith | 141/105 |
| 3,068,987 | 12/1962 | Franklin | 198/435 X |
| 3,091,833 | 6/1963 | Kovach | 432/124 X |
| 3,220,445 | 11/1965 | Talsey | 141/270 |
| 3,267,971 | 8/1966 | Mueller | 141/270 X |
| 3,887,729 | 6/1975 | Cavanagh | 118/324 X |
| 4,308,667 | 1/1982 | Roos et al. | 34/203 X |
| 4,312,292 | 1/1982 | Smith et al. | 427/425 X |
| 4,439,146 | 3/1984 | Sugita | 414/156 X |
| 4,695,482 | 9/1987 | Weiswurm | 427/96 |
| 4,738,219 | 4/1988 | Fujisawa | 427/426 X |
| 4,745,011 | 5/1988 | Fukuta et al. | 427/426 |
| 4,770,122 | 9/1988 | Ichihashi et al. | 118/697 |
| 4,842,890 | 6/1989 | Sessa et al. | 427/425 X |
| 4,942,910 | 7/1990 | Hamamura | 141/9 |
| 4,947,787 | 8/1990 | Grah et al. | 118/324 |
| 5,019,409 | 5/1991 | Wesling et al. | 427/96 |

FOREIGN PATENT DOCUMENTS

| | | | |
|---|---|---|---|
| 2726732 | 1/1979 | Fed. Rep. of Germany | 427/426 |
| 2429735 | 2/1980 | France | 414/157 |
| 1-226599 | 9/1989 | Japan | 141/105 |
| 1341697 | 12/1973 | United Kingdom | 414/196 |

*Primary Examiner*—Henry J. Recla
*Assistant Examiner*—Casey Jacyna
*Attorney, Agent, or Firm*—Oblon, Spivak, McClelland, Maier & Neustadt

[57] ABSTRACT

While the work-mounting sections of the work mounting member is intermittently rotated around the circle by a driving mechanism, works are fed to the work mounting sections at the first position by a work supplying device, predetermined liquid mixture is injected to and applied on works, at the third position, by a injecting mechanism, and those works which have been applied with the liquid mixture are discharged from the work mounting sections, at the second position, by a work discharging mechanism. Upon completion of injection of the liquid mixture in the works, the work mounting sections is moved and is stopped when the next work comes to the third position, and the liquid mixture is likewise injected to and applied on the work. The above operation is repeated, so that injection of the liquid mixture to works, supplying works onto the work mounting section and discharging them therefrom are sequentially executed while the work mounting sections are intermittently rotated around the circle.

8 Claims, 7 Drawing Sheets

LIQUID-MIXTURE AUTO-APPLYING APPARATUS

This application is a continuation of application Ser. No. 07/545,616, filed on Jun. 29, 1990, now abandoned.

BACKGROUND OF THE INVENTION

The present invention generally relates to an apparatus for automatically applying a liquid mixture for use in providing electric insulation, sealing, bonding and adhering of electronic components, electric components and fine parts, such as bonding of a semiconductor integrated circuit board, epoxy resin molding of a magnetic head and epoxy resin coating on electric components of an automobile. More particularly, this invention relates to a liquid-mixture auto-applying apparatus suitable for mixing a hardener to a main agent of an adhesive, such as an epoxy resin, urethane resin or silicone resin, then injecting and applying the liquid mixture onto the works.

Conventional apparatuses for applying a mixture of two liquids comprise pallets each having work-mounting portions of a circular hole arranged in rows and columns to hold works, and dispensers for injecting a liquid mixture of an adhesive onto the works mounted on the pallets. The prior art apparatuses are classified into a pallet moving type which moves pallets in the X and Y directions (row and column directions) to position specific works mounted on a pallet at where the dispensers are located, and a dispenser moving type which moves dispensers in the X and Y directions above specific works, with the pallets fixed. In either type of apparatus, the dispensers are designed to be vertically movable to inject an adhesive liquid mixture into works.

These prior art apparatuses, however, have the following shortcomings.

First, the former pallet moving type requires an X-Y table for aligning the pallets. This X-Y table should be able to align the pallets at very high precision, which inevitably increases the manufacturing cost of the apparatus. In addition, since the individual works arranged in rows and columns on a pallet are moved in the X and Y directions to a predetermined injecting position, the moving time becomes long and the productivity is impaired.

In the latter dispenser moving type, it is difficult to provide a plurality of dispensers. This design restriction does not permit the use of different dispensers for different types of works. In addition, it requires time to move the dispensers in the X and Y directions to the desired position, thus making it difficult to improve the productivity. Further, movement of the dispensers inevitably requires very large space, which enlarges the apparatus.

SUMMARY OF THE INVENTION

Accordingly, it is an object of the present invention to provide a liquid-mixture auto-applying apparatus which can significantly shorten the moving time for alignment between an injector and a work, can facilitate provision of a plurality of injectors, thus improving the productivity, is manufactured at a low cost and is easy to be made compact.

According to the present invention, there is provided a liquid-mixture auto-applying apparatus, which comprises a work mounting member having work mounting sections arranged in a circle, for receiving works; driving means for driving the work mounting member to intermittently rotate the work mounting sections around the circle; work supplying means for supplying works to the mounting sections at a first position in a moving locus of the work mounting sections; work discharging means for discharging the works from the work mounting member at a second position in the moving locus of the work mounting sections; conveying means for conveying works discharged from the work mounting sections to a predetermined location; and injecting means for mixing two, three or more liquids and injecting the liquid mixture on the works at a third position which is between the first and second position in the moving locus of the work mounting sections.

In this invention, while the work-mounting sections of the work mounting member is intermittently rotated around the circle by driving means, works are fed to the work mounting sections at the first position by work supplying means, a predetermined liquid mixture is injected to and applied on works, at the third position, by injecting means, and those works which have been applied with the liquid mixture are discharged from the work mounting sections, at the second position, by work discharging means. Upon completion of injection of the liquid mixture in the works, the work mounting sections is moved and is stopped when the next work comes to the third position, and the liquid mixture is likewise injected to and applied on the work. The above operation is repeated, so that injection of the liquid mixture to works, supplying works onto the work mounting section and discharging them therefrom are sequentially executed while the work mounting sections are intermittently rotated around the circle. Unlike the prior art, therefore, it is possible to eliminate the time conventionally required for the pallet or dispenser to move in the X-Y directions in order to align the injecting means to works, thus prominently increasing the processing speed. The works may be supplied and discharged at the same time the work mounting section in intermittent motion is stopped for injection of the liquid mixture. Alternatively, the works may be supplied and discharged while the work mounting section is moving.

DETAILED DESCRIPTION OF THE PREFERRED EMBODIMENTS

Preferred embodiments of the present invention will now be described referring to the accompanying drawings.

Figure 1:
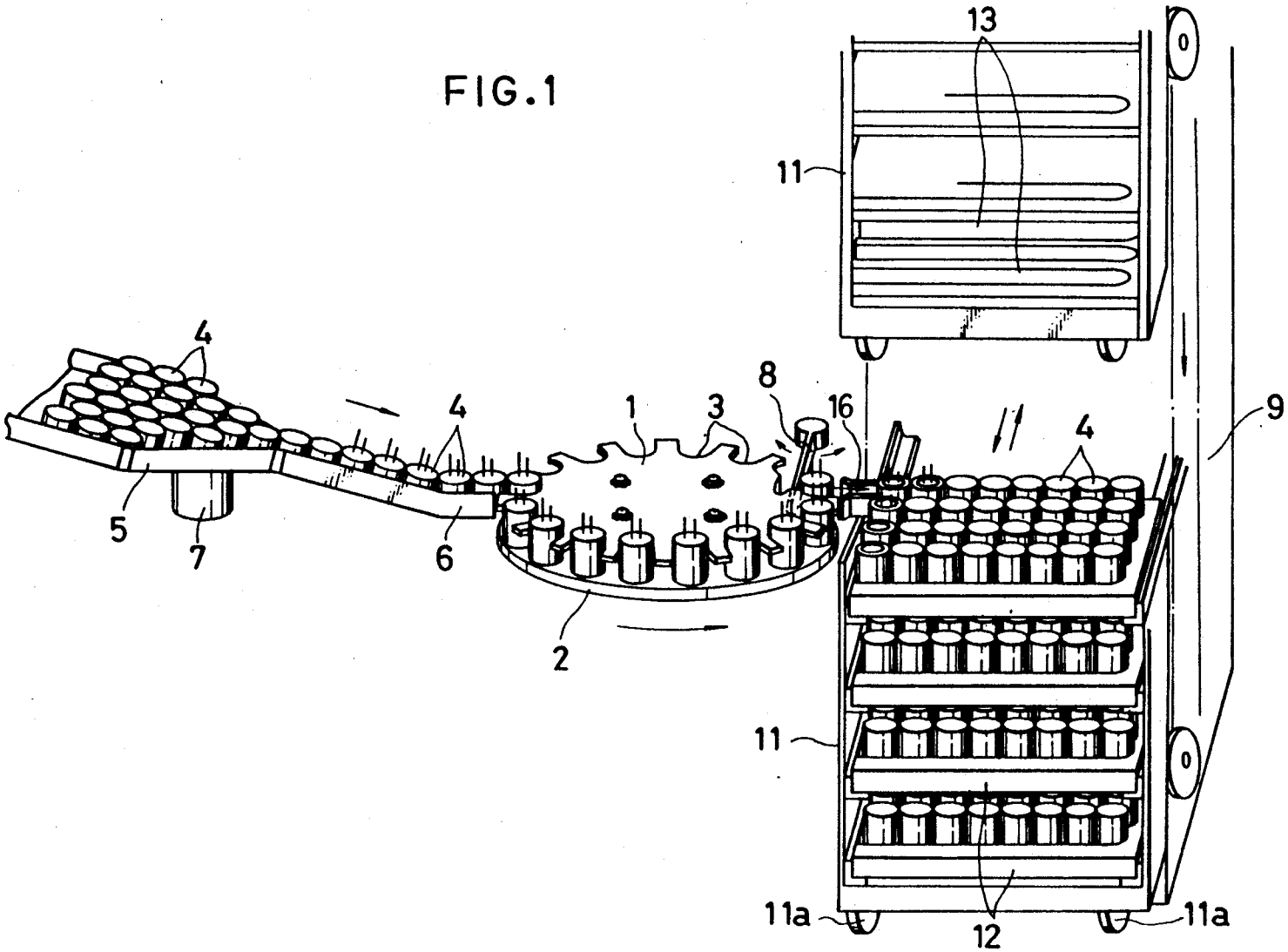
FIG. 1 is a schematic perspective view illustrating a work moving portion of a liquid-mixture auto-applying apparatus according to a first embodiment of the present invention.
Figure 2:
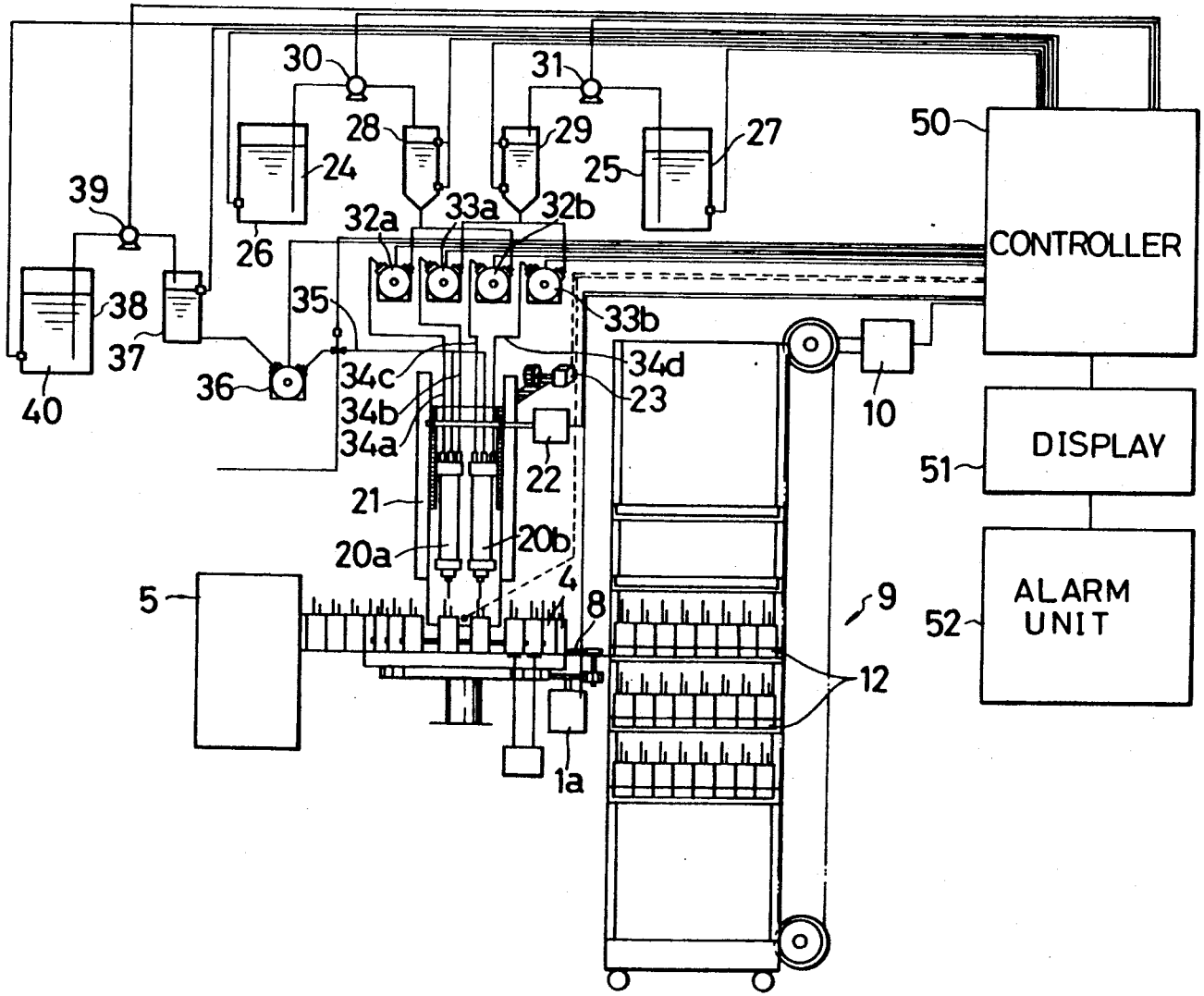
FIG. 2 is a schematic front view showing a mixture injecting portion of the apparatus to inject a mixture of a main agent and hardener.

As shown in FIGS. 1 and 2, disk-shaped mounting table 2 is provided rotatable with its center rotary shaft perpendicular. Mounting table 2 is rotated in the direction of the arrow in FIG. 1 by the rotation of motor 1*a*. Index table 1 having substantially the same diameter as mounting table 2 is secured coaxial to, and located above, the mounting table 2 with the proper space therebetween. Index table 1 has its peripheral portion cut away to provide engaging portions (mounting portions) 3 with the proper pitches therebetween, each having a semicircular shape to match the shape of columnar works 4. Engaging portions 3 are shaped to have their radius slightly larger than that of works 4.

Hopper 5 for works 4 is disposed at the side of index table 1 and is inclined slightly downward toward the index table. Hopper 5, which holds a number of works 4, has chute portion 6 whose distal end is located at the first position of the periphery of index table 1. Vibrator 7 is provided to hopper 5, so that, when activated, it applies fine vibration to hopper 5 to feed works 4 on the hopper toward index table 1 with the help of the inclination of the hopper.

Feed lever 8 with its rocking center shaft perpendicular is provided at that peripheral portion (second position) of index table 1 which is located nearly opposite to where chute portion 6 of hopper 5 is disposed. This feed lever 8 is also driven by motor 1*a* which rotates index table 1. Pallet-elevating device 9 is disposed on the second position side; this device 9 lifts pallet-holding case 11 up or down by the forward/reverse rotation of motor 10. Pallet-elevating device 9 can also move pallet-holding case 11 horizontally in the tangent direction of index table 1. Pallet-holding case 11 has pallets 12 mounted thereon in four stages, for example, each pallet having a plurality of grooves 13 extending from that edge on the index table side to the opposite edge. Bridge member 16 is provided between pallets 12 and index table 1. Rocking motion of feed lever 8 separates work 4 from the associated engaging portion 3 of index table 1 and guides the work through bridge member 16 in the associated groove 13 of pallet 12.

Figure 3A:
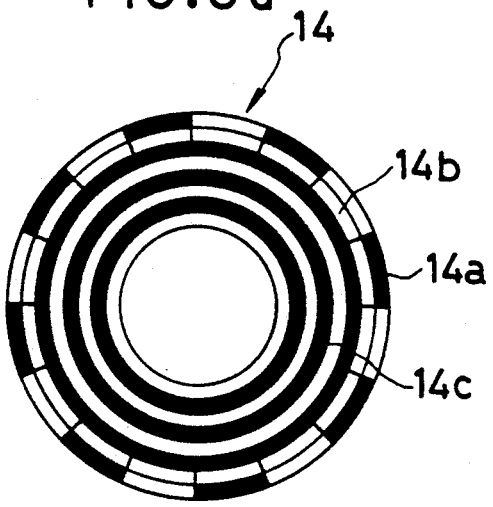
FIG. 3*a* and 3*b* are schematic diagrams illustrating an index code provided to an index table of this apparatus.
Figure 3B:
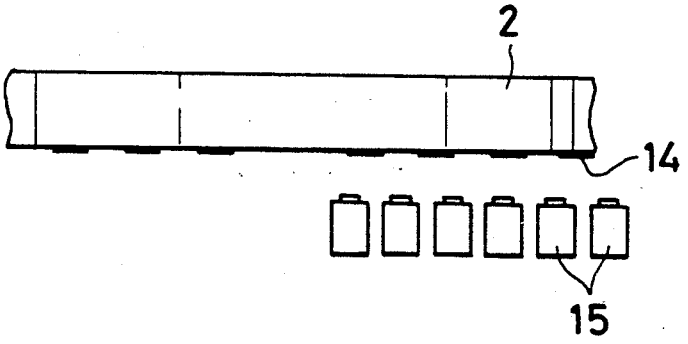

Index codes 14 as shown in FIG. 3*a* are affixed to the bottom of mounting table 2. Optical sensors 15 are located below mounting table 2. Operation signals are recorded in two outer rows of code portions of each index code 14. In this case, code 14*a* specifies an intermittent operation while code 14*b* specifies a stop position. Code 14*c* described inward of each index code 14 is constituted of a plurality of concentrical circular bands. When mounting table 2 is set, code 14*c* is optically read as a binary code to set various parameters for the works. These parameters include the amount of adhesive to be injected, the mixing ratio of the main agent to the hardener in the adhesive, information on the type of products, the upper and lower positions of the dispenser nozzle, and the product feeding speed.

As shown in FIG. 2, two dispensers 20*a* and 20*b* are supported, by supporting unit 21, above the intermediate position within the work moving locus connecting the work feeding position (first position) to index table 1 and the work discharging position (second position) in an up-and-down movable manner. These dispensers 20*a* and 20*b* move upward and downward through a gear and a spur gear attached to the rotary shaft of motor 22 by the forward/reverse rotation of motor 22. Supporting unit 21 can be moved in the radial direction of index table 1 slightly by another motor 23.

Main agent 24 of the adhesive is retained in container 26, while hardener 25 is reserved in container 27. Main agent 24 is fed out to tank 28 from container 26 by pump 30, and hardener 25 is fed to tank 29 from container 27 by pump 31. The levels of the liquids in tanks 28 and 29 are detected by proper sensors, and the result of the detection is input to controller 50. This controller 50 drives pumps 30 and 31 to respectively supplement the main agent and hardener tanks 28 and 29 in order to set the liquid level in each tank constant.

Tank 28 has a liquid outlet connected via tubes 34*a* and 34*c* to dispensers 20*a* and 20*b*, respectively. Tank 29 has its liquid outlet connected via tubes 34*b* and 34*d* to dispensers 20*a* and 20*b*, respectively. Tank 37 and container 38 containing cleaning agent 40 are connected via tube 35 to dispensers 20*a* and 20*b*. Cleaning agent 40 in container 38 is supplied to tank 37 through pump 39 provided to tube 35, and is likewise supplied to dispensers 20*a* and 20*b* by pump 36 provided to tube 35. A level sensor is provided on tank 37, and its detection signal is input to controller 50, which controls the driving of pump 39 to set the level of the cleaning agent in tank 37 constant.

A motionless mixer (not shown) is disposed inside each dispenser 20*a*, 20*b* so that pressurized liquid (main agent 24 and hardener 25) introduced in each dispenser by the associated pumps flows through the motionless mixer to be uniformly mixed before the liquid is discharged from an output provided at the bottom of dispenser 20*a*, 20*b*. The motionless mixer may be of an ordinary type which has a plurality of spiral blades of two types connected together; the first type rotates clockwise and the other rotates counterclockwise.

Controller 50 receives the detection signals of the individual level sensors, and controls the drive and stop of pumps 30, 31 and 39 based on the received information. Controller 50 also receives various types of information, such as the mixing ratio of main agent 24 and hardener 25, the amount of an adhesive to be discharged from dispensers 20*a* and 20*b* and the type of works, acquired by scanning index codes 14 or the like, computes predetermined processing parameters, and controls the driving of pumps 32*a*, 32*b*, 33*a* and 33*b* and motors 1*a*, 10, 22 and 23 based on the computation result.

Controller 50 is connected with display 51 which displays parameters read from index codes 14, such as the production condition, the amount of the liquid mixture to be discharged, the model number of products and the quantity of the products. Display 51 is connected with alarm unit 52 which generates an alarm upon occurrence of an abnormality in pallet feeding, discharging pressure and tank level, etc.

According to the adhesive-coating device of the present embodiment thus constructed, predetermined index table 1 is mounted on the apparatus depending on the type of works 4 to which the adhesive is to be applied. This index table 1 is provided with engaging portions 3 having a shape to match the outline of each work 4, and mounting table 2 is secured concentrical to index table 1. Index codes 14 representing information of works 4 are affixed to the bottom of mounting table 2. When index table 1 is rotated by motor 1*a*, index codes 14 are scanned and detected by optical sensors 15 and the detected signal is stored in digital form in controller 50. Codes 14*a* and 14*b* of each index code 14 are always read by optical sensors 15, and the scanned and detected signals are always input to controller 50. Every time when codes 14*a* and 14*b* are scanned and rotation and stopping of index table 1 is instructed, controller 50 drives and stops motor 1*a* to thereby rotate index table 1 in a predetermined intermittent manner determined by the type of works 4.

Works 4 are placed in hopper 5, and when fine vibration is applied to hopper 7 by vibrator 7, works 4 in the hopper slide through chute 6 onto index table 1. As this index table 1 is intermittently rotating, engaging portion 3 of index table 1 arrives at the distal end portion of shoot 6, the associated work 4 is moved on mounting table 2 therefrom so that it is fitted in engaging portion 3. Work 4, while engaged with engaging portion 3, moves along the circumferential locus with rotation of index table 1.

Work 4 is stopped at the location of the injectors, dispensers 20*a* and 20*b*, disposed at the proper locations in the work moving locus, under the control of controller 50 in response to an instruction of the associated index code 14. The rotation of motor 22 moves dispensers 20*a* and 20*b* downward to position their outlets directly above works 4. Then, pumps 32*a* and 33*a* and pumps 32*b* and 33*b* are driven, main agent 24 and hardener 25 are supplied with pressure to both dispensers 20*a* and 20*b*. Main agent 24 and hardener 25 are mixed in dispensers 20*a* and 20*b* while passing through the respective static mixers to be a uniform adhesive. This adhesive is then discharged from each dispenser and is applied on work 4 directly below the associated dispenser.

The rotation of motor 22 moves dispensers 20*a* and 20*b* upward, and the rotation of motor 1*a* rotates index table 1 by a predetermined angle. When those works 4 which have not yet been applied with an adhesive directly below dispensers 20*a* and 20*b*, index table 1 stops and the dispensers move downward to discharge the adhesive on the works.

The upward movement of the dispensers, rotation of index table 1 and so forth are repeated thereafter. Main agent 24 and hardener 25 in tanks 28 and 29 are supplemented from containers 26 and 27 by pumps 30 and 31 respectively. Controller 50 controls the intermittent rotation of index table 1 and the driving of these motors and pumps. In this case, the amounts of main agent 24 and hardener 25 to be supplied to dispensers 20*a* and 20*b*, respectively by pumps 32*a* and 33*a* and pumps 32*b* and 33*b*, are controlled by controller 50 based on the result of scanning code 14*c* of index code 14 located at the bottom of mounting table 2.

While works 4 supplied to index table 1 intermittently move around, works 4 are sequentially applied with an adhesive by dispensers 20*a* and 20*b*. When work 4 moves to where feed lever 8 is located, it is discharged from index table 1 by lever 8 driven by motor 1*a* and is placed in the associated groove 13 in pallet 12 through bridge member 16. When one groove 13 is filled with works 4, pallet-holding case 11 holding this pallet 12 is moved horizontally by elevating device 9 so that an adjoining empty groove 13 comes to meet bridge member 16. After one pallet 12 is fully loaded with works 4, pallet-holding case 11 is moved downward by the pitch equal to the gap between pallets 12 by elevating device 9, so that upper empty pallet 12 comes to be aligned with bridge member 16. When all pallets 12 in pallet-holding case 11 are fully loaded with works 4 through repetitive horizontal movement and downward movement of case 11, the case is moved downward to the floor or the lowest position. Then, case 11 is carried out on the floor by means of casters 11*a* provided at the bottom. Meanwhile another pallet-holding case 11 holding empty pallets 12 are mounted at the upper edge portion on elevating device 9 and is moved downward to a predetermined position by elevating device 9 to be ready to receive another load of works 4 after the aforementioned pallet-holding case 11 fully loaded with works 4 is detached from elevating device 9. Then, operation of feeding lever 8 feeds those works 4 which have been applied with an adhesive into grooves 13 in pallet 12. As the above operation is repeated, adhesive-applied works 4 are loaded in pallet 12 from index table 1.

If the positions of the outlets of dispensers 20*a* and 20*b* are not aligned with the positions of works 4 conveyed on index table 1 or the moving locus of works 4, dispensers 20*a* and 20*b* need to be slightly moved together with supporters 21 in the radial direction of index table 1 by rotating motor 23 for fine adjustment.

To change the type of an adhesive, it is desirable that after cleaning agent 40 is supplied to dispensers 20*a* and 20*b* by means of pump 36 to clean them, a new main agent and a new hardener should be supplied to the dispensers.

According to this embodiment, adhesive-unapplied works 4 are always supplied to index table 1 and adhesive-applied works 4 are always discharged from index table 1, while dispensers 20*a* and 20*b* are applying the adhesive on works 4. As the step of discharging the adhesive from dispensers 20*a* and 20*b* and the step of aligning dispensers 20*a* and 20*b* with works 4 are executed at the same time, it is unnecessary to provide the time conventionally require for moving pallets 12 and dispensers 20*a* and 20*b*, i.e., the time in which dispensers 20*a* and 20*b* are not operation. This shortens the processing time and significantly increases the quantity of works 4 producible per unit time as a consequence.

According to the embodiment, unlike the prior art, it is unnecessary to provide a mechanism for driving pallets or dispensers to align the latter with a number of works arranged rows and columns, so that the apparatus can very easily the made compact.

Although there are two dispensers used in this embodiment, the quantity of the dispensers is not limited to two, but may be set to three or more as needed according to works or like that are to be applied with an adhesive. It is also possible to select specific ones from a plurality of dispensers and use only those properly selected ones. In addition, pressure sensors may be provided between pump 32*a* and dispenser 20*a*, or pump 32*b* and dispenser 20*b*, etc., and at the outlets of the dispensers. By measuring the liquid pressures at those portions, it is possible to check if the liquid mixture is discharged, confirm the amount of the liquid mixture discharged and the mixing ratio, grasp the mixture discharging speed, and detect blocking of the motionless mixer in each dispenser when occurred. Further, a color sensor may be provided to detect a degree of color of the adhesive liquid on each work on which is applied a liquid mixture. The existence of the liquid mixture can be confirmed and the mixing ratio of the liquid mixture can be detected by the color sensor. Further, the types of the liquids are not limited to two as in the above embodiment, but containers and tanks may be arranged to permit the use of three or more types of liquids to form a liquid mixture. Furthermore, the work-mounting device is not limited to the index table, but a belt type may be used as well.

The second embodiment of the present invention will be described below.

Figure 4:
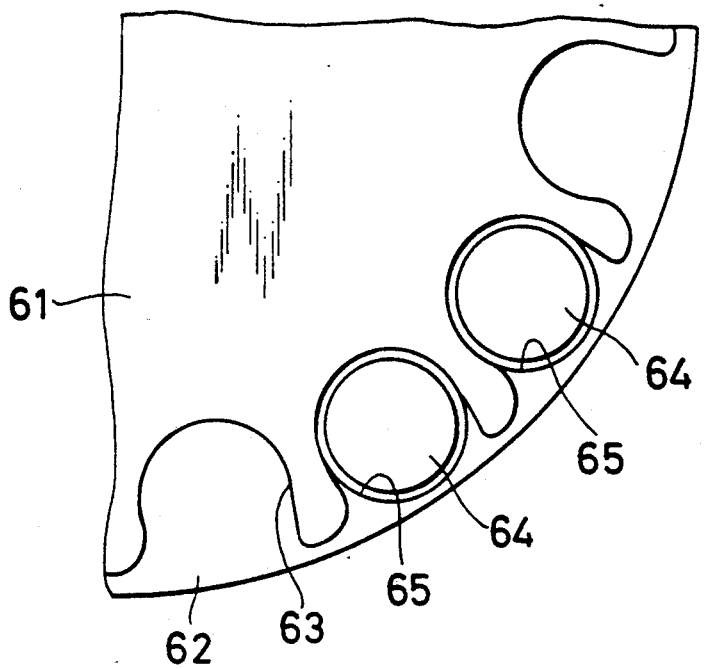
FIG. 4 is a plan view showing an index table used in a liquid-mixture auto-applying apparatus according to a second embodiment of the present invention.
Figure 5:
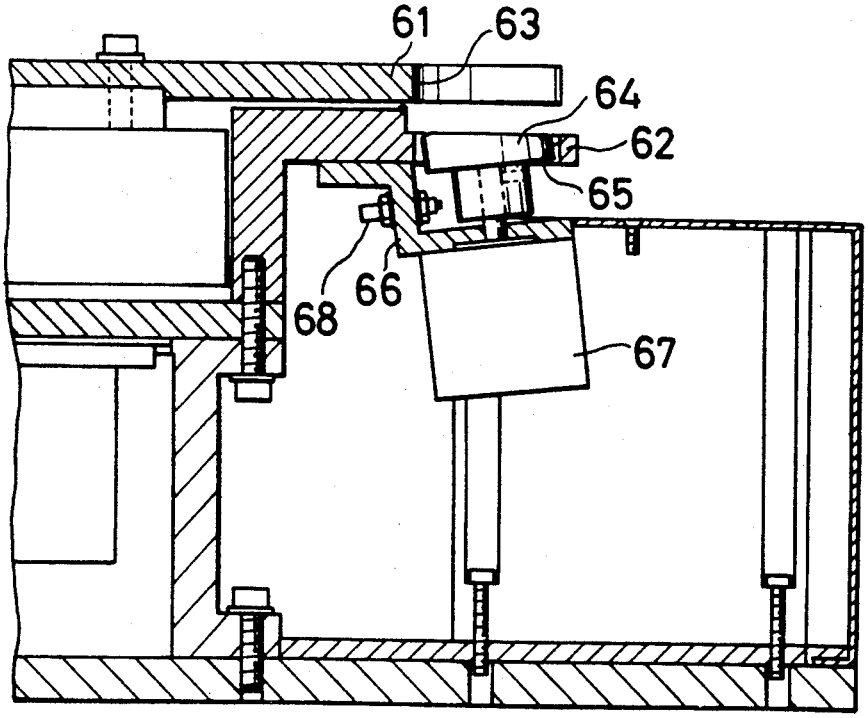
FIG. 5 is a vertical section view of the apparatus.

This embodiment differs from the first embodiment in the structures of the index table and mounting table. As shown in FIGS. 4 and 5, index table 61 provided with semicircular engaging portions 63, and disk-shaped mounting table 62 are arranged with its axis coaxial to that of index table 61. In the second embodiment, mounting table 62 is secured to the apparatus body and is not movable. Only index table 61 which acts as a work mounting table is driven by a motor (not shown) to intermittently rotate in the same direction as indicated by the arrow shown in FIG. 1. Accordingly, works 4 fed to index table 61 are fitted in engaging portions 63 and slide on mounting table 62 with the rotation of index table 61.

According to the second embodiment, two circular holes 65 for receiving tables 64 are formed in specific two portions of mounting table 62. Holes 65 are located between the third position in the work moving locus where dispensers 20*a* and 20*b* are disposed and the second position where works 4 are discharged, so that holes 65 are aligned with semicircular engaging portions 63 when index table 61 is stopped intermittently. Tables 64 of a disk shape are fitted in holes 65; the thickness of each table 64 varies along the line passing the center. Each of table 64 is secured to the driving shaft of motor 67 in such a way that the bottom of table 64 is normal to this driving shaft. Motor 67 is secured to mounting table 62 through attaching member 66 in such a way that the top surface of motor 67 becomes level with the top of mounting table 62 when the rotational position of table 64 is at the reference position. That is, the driving shaft of motor 67 is slightly inclined with respect to the vertical direction. Sensor 68 for positioning work 4 is provided near table 64.

In the liquid-mixture auto-applying apparatus with the above structure, works 4 are moved on mounting table 62 from chute portion 6 to come in engagement with engaging portions 63 of index table 61. In this state, works 4 slide on mounting table 62 along the peripheral portion thereof with the rotation of index table 61. In this case, if two dispensers 20*a* and 20*b* are disposed, works 4 intermittently move by a distance twice the pitch between engaging portions 63 in a single motion.

When works 4 come to where tables 65 are located, works 4 slide onto tables 65 from mounting table 62. Then, motor 67 starts rotating and tables 64 rotate while carrying works 4 thereon. In this case, as the rotary shafts of motors 67 are inclined with respect to the vertical direction, the top of each table 64 vertically vibrates during rotation. As a result, the liquid-applying face (top surface) of each work 4 revolves around the line extending from the driving shaft of associated motor 67. Consequently, the applied liquid potted from dispensers 20*a* and 20*b* thoroughly move on the top surface to be coated thereon with a uniform thickness. This embodiment can therefore provide uniform works without variation in the thickness of the coat.

Figure 6:
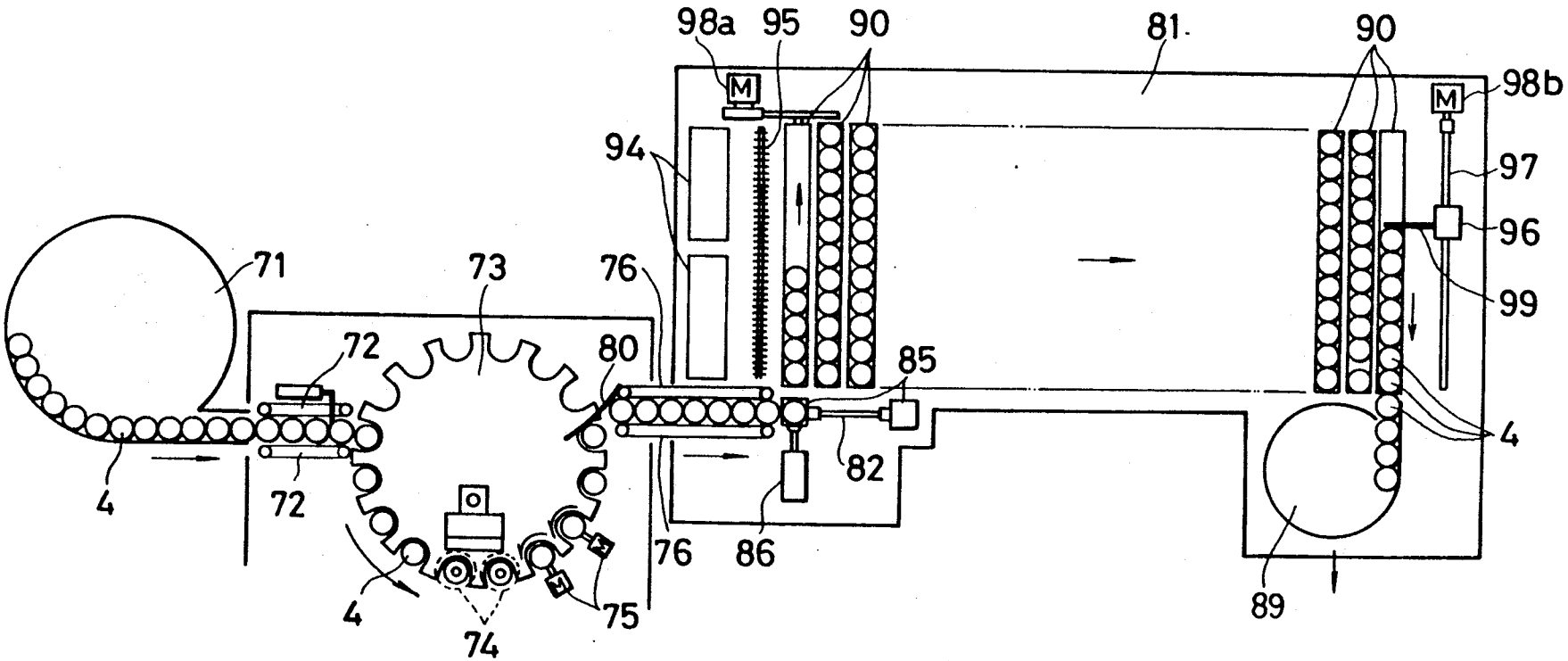
FIG. 6 is a schematic plan view showing a liquid-mixture auto-applying apparatus according to a third embodiment of the present invention.
Figure 7:
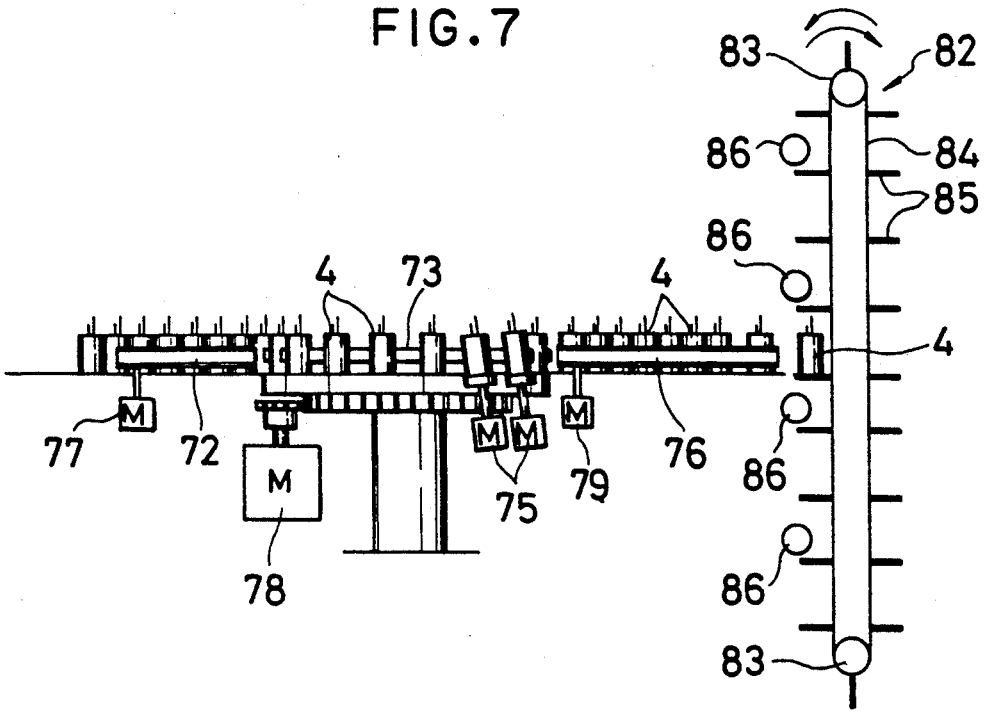
FIG. 7 is a schematic front view showing an index table and a chain lift of the apparatus.
Figure 8:
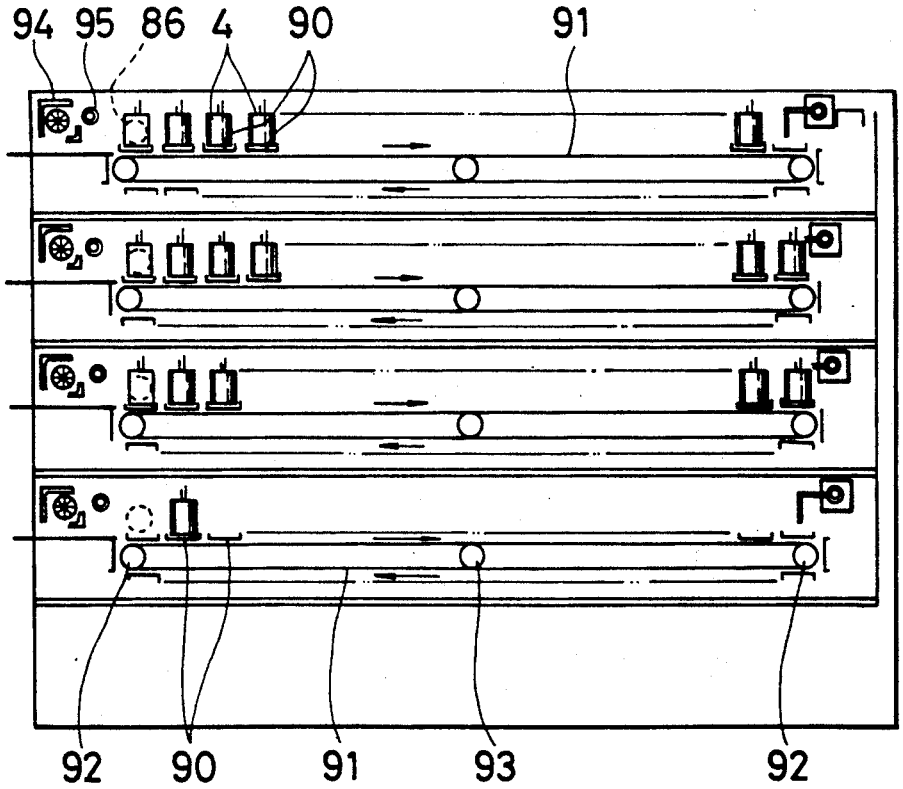
FIG. 8 is a schematic vertical section view of a heating furnace of the apparatus.

Referring now to FIGS. 6 to 8, the third embodiment of the present invention will be described. This embodiment is designed such that works leaving the index table are continuously fed to a heating furnace to sequentially heat the liquid applied on the top surfaces of the works.

As shown in FIG. 6, works 4 stored in feeder 71 are continuously fed onto index table 73 via a pair of belts 72. Belts 72 are driven by motor 77, and index table 73 by motor 78. Works 4 move as index table 73 intermittently rotates, and receive a liquid from dispenser units 74 during the movement. The liquid is evenly applied over the liquid-applying faces of works 4 to provide liquid coating with a uniform thickness by spinning units 75 like those shown in FIGS. 4 and 5. Works 4 are moved to feeding unit 76 from index table 73 by guide 80 provided in the work moving locus. This feeding unit 76 has a pair of parallel belts which are driven by motor 79; works 4 are held in a row between the belts while being sequentially sent to heating furnace 81.

A chain lift 82 is provided in heating furnace 81 on the work supplying side of feeding unit 76. A pair of sprockets 83 are disposed at the upper and lower portions with the proper distance in this chain lift 82, and endless belt 84 is pass over sprockets 83. A plurality of buckets 85 are attached with given intervals to this belt 84, with their faces normal to the belt. Each bucket 85 is wide enough to receive single work 4.

A number of trays 90 are disposed in four stages in the up-and-down direction on the side of lift 82.

As shown in FIG. 8, wide conveyor belt 91 is pass over a pair of pulleys 92 at each stage in a horizontally movable manner, as indicated by the arrow in this diagram. This belt 91 is driven by motor 98*a*. In the illustrated example, roller 93 is arranged at the center between pulleys 92 for the purpose of reinforcement. A number of elongated trays 90 are attached to belt 91 with their lengthwise direction meeting the width direction of the belt. A plurality of works 4 are mounted in a row in each tray. When belt 91 is driven, a group of trays 90 move away from lift 82 in the upper moving region, and comes back toward lift 82 in the lower moving region.

Flow fan 94 is provided at the side of lift 82 in each stage in heating furnace 81. A rod-shaped heater 95 with a fan is provided immediately before the air outlet of flow fan 94. Air coming from fan 94 is therefore heated by heater 95 and circulates in heating furnace 81. At each stage of heating furnace, individual works 4 placed on tray 90 are heated with the hot air so that the applied liquid is hardened.

In the moving range in lift 82 where buckets 85 vertically move, cylinders 86 are respectively provided at those positions which are aligned with belts 91 at four stages in heating furnace 81. Each cylinder 86 has its piston rod arranged toward buckets 85. As the piston rod of cylinder 86 is thrust, it pushes one work 4 out of bucket 85 onto tray 90.

With works 4 loaded on tray 90 by lift 82 and cylinder 86, belt 91 conveys works 4 from one end on the side of lift 82 and cylinder 86 to the other end. A discharging unit for discharging works 4 from tray 90 is provided at the other end of the conveying region of belt 91. This discharging unit has screw rod 97 extending in parallel to tray 90 located at the discharging side end of belt 91. This screw rod 97 is rotated by motor 98*b*. Movable body 96 having an internal thread formed is engaged n screw rod 97. The movable body 96, which is restricted not to rotate, is movable along screw rod 97. When screw rod 97 rotates in the forward or reverse direction, therefore, movable body 96 moves in the forward or backward in accordance with the rotational direction of screw rod 97.

Arm 99, which extends toward work 4 on discharging tray 90 located at the discharging end of belt 91, is attached to movable body 96. Circular table 89 is detachably provided at the proximity of discharging tray 90 on the distal end side of screw rod 97.

In the liquid-mixture auto-applying apparatus thus constructed, works 4 are continuously fed onto index table 73 from feeder 71 by means of belts 72. A liquid is put on the top of work 4 by dispenser unit 74 and the applied liquid is thoroughly coated on the top of the work in a uniform thickness by spinning unit 75.

Liquid-applied works 4 are continuously fed in heating furnace 81 from index table 73 via guide 80 and feeding unit 76.

First, works 4 conveyed between a pair of belts of feeding unit 76 are moved on buckets 85 of lift 82 from feeding unit 76. In lift 82, belt 84 intermittently rotates pitch by pitch of buckets 85 in the direction where works 4 on buckets 85 are lifted.

When works 4 are lifted to the uppermost conveyor belt 91 in heating furnace 81, cylinder 86 provided for this belt 91 is actuated to thrust its piston so that works 4 on bucket 85 are loaded on tray 90 on the uppermost belt 91. As belt 84 of lift 82 is intermittently moved, works 4 are continuously loaded in a row on tray 90. When one tray 90 is fully loaded with works 4, conveyor belts 91 are intermittently moved by one pitch of tray 90. As a result, empty tray 90 comes in front of cylinder 86.

When one tray 90 attached to the uppermost belt 91 is fully loaded with works 4, cylinder 86 at the second stage is actuated to send works 4 fed by lift 82 onto tray 90 attached to belt 91 at the second stage. When this tray 90 is fully loaded with works 4, belt 84 of lift 82 is rotated in the reverse direction to move works 4 fed onto bucket 85 from feeding unit 76 down to the height to be aligned with belt 91 at the third stage. Works 4 are then loaded on tray 90 attached to belt 91 at the third stage by the associated cylinder 86. Thereafter, the above operation is repeated to load works 4 on a tray at the fourth stage, then belt 84 of lift 82 is rotated in the forward direction to load works 4 again on trays at the first and second stages. In this manner, works 4 are sequentially fed on the individual trays 90. Works 4 in each tray 90 at each stage is heated by the hot air coming through heater 95 from flow fan 94. This heats the liquid applied on works 4 and hardened it.

When tray 90 full of works at each stage is conveyed near the discharging unit, motor **98*b* is rotated in the forward direction. This rotates screw rod 97 in the forward direction, and movable body 96 moves toward the distal end of screw rod 97 from the proximal end. As a result, arm 99 is thrust to feed works 4 on tray 90 onto table 89**.

When all of works 4 on one tray 90 are moved on table 89, motor 98 is rotated in the reverse direction and movable body 96 and arm 99 retreat. Table 89 carrying works 4 is carried out to a separate work storing place.

Subsequently, belt 91 is moved by one pitch and another tray 90 fully loaded with works 4 is positioned at the proximity of the discharging unit. Likewise, the discharging unit feeds works 4 on tray 90 onto another, newly mounted table 95.

Works 4 continuously supplied to heating furnace 81 from index table 73 are heated by the hot air in the furnace, then are sequentially discharged on table 89.

Figure 9:
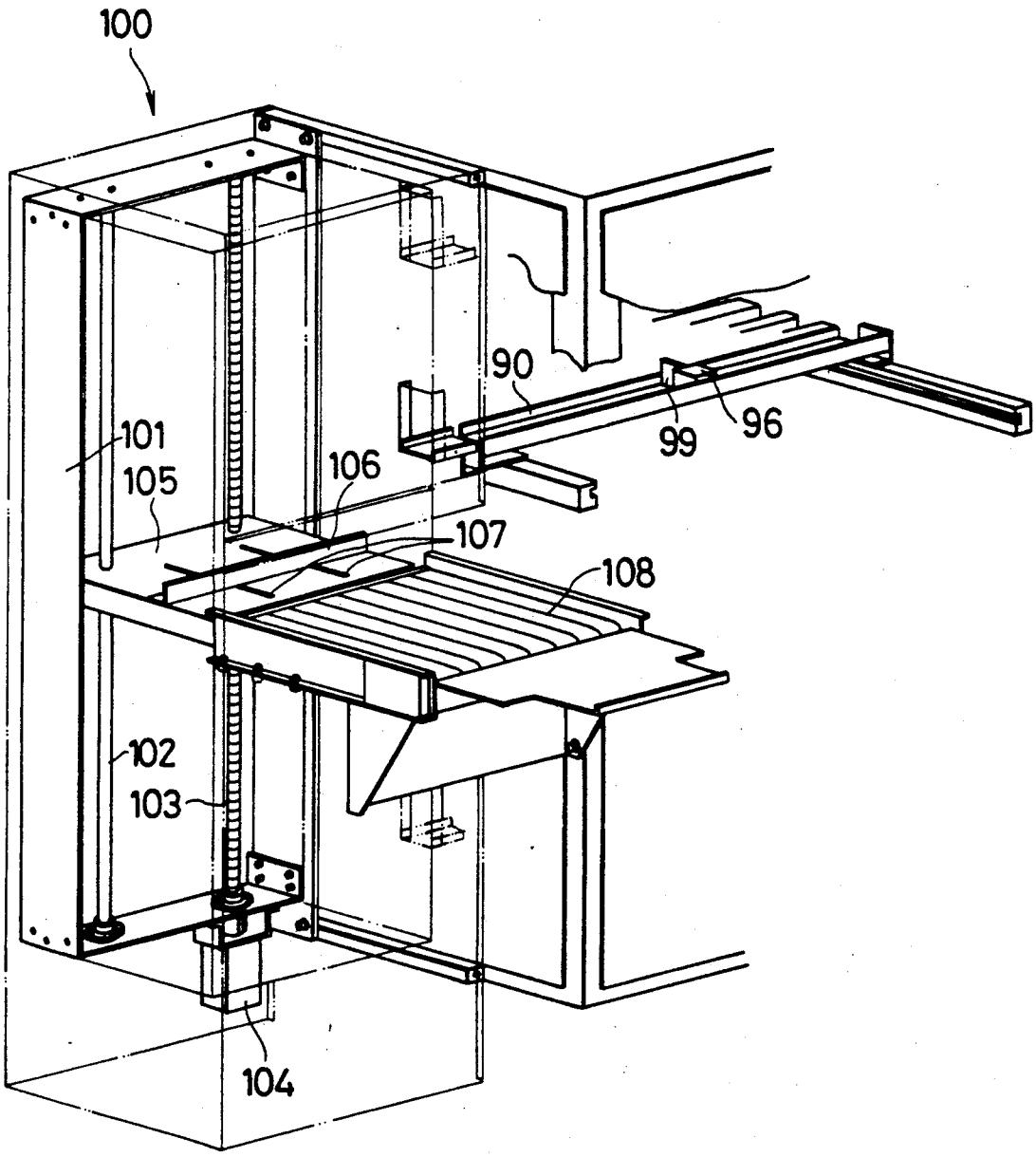
FIG. 9 is a schematic perspective view of an elevating device of a fourth embodiment according to the present invention.

The fourth embodiment of the present invention will now be described referring to FIG. 9. In this embodiment, table 89 of the work discharging unit in heating furnace 81 shown in FIG. 6 is replaced with elevating device 100 so that works 4 coming from heating furnace 81 can be sequentially discharged. It is necessary to arrange discharging table 89 for each of four stages of belt conveyors 91 in the embodiment shown in FIG. 6, whereas the fourth embodiment shown in FIG. 9 requires a single discharging table 108.

In elevating device 100, frame 101 vertically extending is provided with three guide rods 102 (only one illustrated) and screw rod 103 with the proper distance therebetween. Screw rod 103 is rotated in the forward and reverse directions by motor 104. Guide rods 102 and screw rod 103 penetrate four corners of lift table 106, respectively. Screw rod 103 is engaged with an internal thread formed in table 106. When motor 104 rotates in the forward/reverse direction, screw rod 103 rotates accordingly, which sets table 105 in an upward/-downward motion, guided by guide rods 102.

A pair of parallel linear slots 107 are formed in table 105. Movable rod 106 is provided on table 105, with it lengthwise direction normal to slots 107. Movable rod 106 is connected through slots 107 to a driving unit (not shown) mounted at the bottom of table 105, and can be reciprocated in the lengthwise direction of slots 107 by this driving unit.

Receiving table 108 is located in front of movable rod 106.

Elevating device 100 is disposed at the proximity of the distal end of that tray 90 which is positioned on the work discharging side of conveyor belt 91 of heating furnace 81.

In the work discharging device of the thus constructed liquid-applying apparatus, works 4 on tray 90 attached to the uppermost belt 91 are fed forward of tray 90 through arm 99 by the forward movement of movable body 96 which is caused by the rotation of motor 98 (see FIG. 6).

In elevating device 100, lift table 105 is at the position to be aligned with tray 90 driven by movable body 96. Works 4 fed out from tray 90 are moved onto table 105. After al the works 4 in tray 90 are moved on table 105, screw rod 103 rotates by the rotation of motor 104, and table 105 moves downward and stops at the height level with the face of table 108. Then, movable rod 106 is moved forward to move works 4 on table 105 onto table 108. Works 4 are moved to a movable tray (not shown) to be carried out to a storing place (not shown). After all the works 4 on tray 90 attached to the uppermost belt 91 are discharged, table 105 is moved to the height of belt 91 at the second stage by the rotation of motor 104. Works 4 fed out from tray 90 at the second stage are moved onto table 105, then onto table 108. In this manner, works 4 at the individual stages are discharged through one table 108.

An apparatus which applies a ultraviolet, radiant rays, or electromagnetic waves may be provided instead of the heating furnace of the third and fourth embodiments. The adhesive liquid can be hardened by the ultraviolet, radiant rays, or electromagnetic waves.

What is claimed is:

1. A liquid-mixture auto-applying apparatus comprising:

a work mounting turn table having work mounting sections for receiving works arranged in a circle, and a perpendicular rotary shaft at the center of the turn table;

index code means for containing a plurality of predetermined information concerning the works, the index code means being provided on one side of said work mounting turn table;

driving means for intermittently rotating the turn table around the rotary shaft, the turn table being detachably engaged to the driving means;

work supplying means for supplying works to the mounting section at a first position in a moving locus of the work mounting sections;

work discharging means for discharging the works from the turn table at a second position in the moving locus of the work mounting sections;

movable injecting means for mixing a plurality of liquids to make a thermosetting resin liquid mixture and injecting the thermosetting resin liquid mixture on the works at a third position above the works which is between the first and second positions in the moving locus of the work mounting sections;

reading means for reading the index code means during rotation of the turn table and outputting a control signal; and control means for controlling movement and stopping of the turn table and movement and stopping of the injecting means based on the control signal so as to continuously permit the supply of the works to the mounting sections at the first position, align the injecting means over the works at the third position simultaneously with the injection of the thermosetting resin liquid mixture from the injecting means, and permit the discharge of the works from the turn table at the second position.

2. An apparatus according to claim 1, wherein:

the injecting means includes an injector for injecting the liquid mixture onto the works located at the third position in the work moving locus, a first container for holding a first liquid of said plurality of liquids, a second container for holding a second liquid of said plurality of liquids, a first pump for supplying the first liquid to the injector from the first container, and a second pump for supplying the second liquid to the injector from the second container, the first and second liquids being mixed in the injector.

3. A liquid-mixture auto-applying apparatus comprising:

a work mounting turn table having work mounting sections for receiving works arranged in a circle, and a perpendicular rotary shaft at the center of the turn table;

driving means for rotating the turn table intermittently around the rotary shaft, the turn table being detachably engaged to the driving means;

work supplying means for supplying works to the mounting sections at a first position in a moving locus of the work mounting sections;

work discharging means for discharging the works from the turn table at a second position in the moving locus of the work mounting sections;

injecting means for mixing a plurality of liquids to make a thermosetting resin liquid mixture and injecting the thermosetting resin liquid mixture on the works at a third position which is between the first and second positions in the moving locus of the work mounting sections;

control means for controlling movement and stopping of the turn table;

a heating furnace for heating the works where the thermosetting resin liquid mixture is injected and hardening the thermosetting resin liquid mixture;

conveying means for conveying works discharged from the work mounting sections to the heating furnace;

a receiving table means located between the third and second positions in said moving locus for receiving a work; and a driving motor for revolving said receiving table means relative to the work mounting table about a further rotary shaft inclined with respect to the vertical direction, thereby evenly distributing said thermosetting resin liquid mixture on the surface of said work.

4. An apparatus according to claim 3, wherein:

said receiving table means has a receiving face inclined with respect to said further rotary shaft of said driving motor, and said driving motor for driving said receiving table means stops its movement when said receiving face becomes level, thereby enabling said work to be slid into or out of said receiving surface by way of the rotation of said turn table.

5. An apparatus according to claim 3, wherein:

the injecting means includes an injector for injecting the liquid mixture onto the works located at the third position in the work moving locus, a first container for holding a first liquid of said plurality of liquids, a second container for holding a second liquid of said plurality of liquids, a first pump for supplying the first liquid to the injector from the first container, and a second pump for supplying the second liquid to the injector from the second container, the first and second liquids being mixed in the injector.

6. An apparatus according to claim 3, wherein:

said heating furnace comprises a conveyer belt, a plurality of trays attached to said conveyer belt with the longitudinal side thereof perpendicular to the proceeding direction, a feeding means for feeding said works to said tray at one end of said conveyer belt, and a discharging means for discharging said work from said conveyer belt at the other end thereof.

7. An apparatus according to claim 6, wherein:

said heating furnace comprises a plurality of conveyer belts arranged vertically, and said feeding means comprises a first feeding means for feeding works discharged from said turn table to said heating furnace and a second feeding means for selectively feeding to move the works fed from the first feeding means upward or downward to said plurality of the conveyers.

8. An apparatus according to claim 3, wherein:

said heating furnace comprises a hot air providing means for providing hot air to said works.

* * * * *